US008585036B2

(12) United States Patent
Yogev et al.

(10) Patent No.: US 8,585,036 B2
(45) Date of Patent: Nov. 19, 2013

(54) SYSTEMS AND METHODS OF PRINTING USING CONCATENATED MEDIA FEEDER DEVICES

(75) Inventors: Zvika Yogev, Gedera (IL); Hana Shteiman, Nes Ziona (IL)

(73) Assignee: Hewlett-Packard Development Company, L.P., Houston, TX (US)

( * ) Notice: Subject to any disclaimer, the term of this patent is extended or adjusted under 35 U.S.C. 154(b) by 346 days.

(21) Appl. No.: 12/918,313

(22) PCT Filed: Feb. 29, 2008

(86) PCT No.: PCT/US2008/055540

§ 371 (c)(1),
(2), (4) Date: Aug. 18, 2010

(87) PCT Pub. No.: WO2009/108206

PCT Pub. Date: Sep. 3, 2009

(65) Prior Publication Data

US 2010/0327511 A1 Dec. 30, 2010

(51) Int. Cl.
*B65H 3/44* (2006.01)

(52) U.S. Cl.
USPC ..... 271/9.02; 271/9.01

(58) Field of Classification Search
USPC ..... 271/9.01, 9.02, 9.05
See application file for complete search history.

(56) References Cited

U.S. PATENT DOCUMENTS

| | | | | |
|---|---|---|---|---|
| 5,197,590 | A | 3/1993 | Prim et al. | |
| 5,704,609 | A | 1/1998 | Mandel et al. | |
| 5,927,703 | A | 7/1999 | Endo | |
| 7,380,780 | B2 * | 6/2008 | Sasaki et al. | 271/9.02 |
| 7,480,467 | B2 * | 1/2009 | Ueki et al. | 399/23 |
| 7,556,254 | B2 * | 7/2009 | Wada | 271/9.02 |
| 7,715,735 | B2 * | 5/2010 | Nishikata et al. | 399/21 |
| 8,200,103 | B2 * | 6/2012 | Sasaki et al. | 399/16 |
| 2005/0056988 | A1 * | 3/2005 | Lee et al. | 271/9.05 |
| 2005/0104272 | A1 * | 5/2005 | Watanabe et al. | 271/9.05 |
| 2005/0140078 | A1 | 6/2005 | Fujiwara | |
| 2006/0176336 | A1 | 8/2006 | Moore et al. | |
| 2007/0120313 | A1 * | 5/2007 | Wada | 271/9.02 |

FOREIGN PATENT DOCUMENTS

| | | | |
|---|---|---|---|
| GB | 00844673 | A | 8/1960 |
| JP | 2005049392 | A | 2/2005 |
| JP | 2005121886 | A | 5/2005 |
| JP | 2006008357 | A | 1/2006 |
| JP | 2006044882 | A | 2/2006 |

OTHER PUBLICATIONS

International Seraching Authority, ISA 220 ISR & Written Opinion, Nov. 6, 2008, 10 pages, Korean Intellectual Property Office, Republic of Korea.

* cited by examiner

*Primary Examiner* — Kaitlin Joerger

(57) ABSTRACT

A system (100) includes a first end feeder device (103-1), and a second end feeder device (103-2) upstream in a media transport path from the first end feeder device (103-1). Each of the feeder devices (103-1, 103-2, 105-1, 105-2) is configured to feed a piece of a print medium (205) to a neighboring device (103-2, 105-1, 105-2) downstream in the media transport path only after receiving a logical token from the neighboring downstream device (103-2, 105-1, 105-2) corresponding to the piece of print media (205).

20 Claims, 7 Drawing Sheets

SYSTEMS AND METHODS OF PRINTING USING CONCATENATED MEDIA FEEDER DEVICES

BACKGROUND

Printing devices are used to produce desired images, such as text and graphics, on various types of media. Due to the wide scope of applications for which printing is sought and the versatility of printing technology, printing devices are prevalent in modern offices and homes.

In some cases, printing devices may be designed to print to a variety of different types of print media, thus enhancing the versatility and utility of the devices. Many such printing devices include automatic media feeder devices that store different types of print media (i.e. different sizes and/or compositions) in separate trays. Additionally, some automatic media feeder devices may store one type of media in multiple trays, particularly when that particular type of media is used more often by the printing device than other types of media.

When such a printing device begins a printing job, it typically designates a piece of media from those available in the feeder device and requests the feeder device to provide the selected media type. The feeder device can then transport the requested piece of print media to the printing device using a print medium feed mechanism which may include, for example, motorized rollers, belts, and/or suction.

Some printing devices are coupled to several concatenated feeder devices to allow access to greater amounts of media storage and/or more types of print media. In a system of concatenated feeder devices, print media may be transported through more than one of the feeder devices before being received by the printing device.

BRIEF DESCRIPTION OF THE DRAWINGS

The accompanying drawings illustrate various embodiments of the principles described herein and are a part of the specification. The illustrated embodiments are merely examples and do not limit the scope of the claims.

Throughout the drawings, identical reference numbers designate similar, but not necessarily identical, elements.

DETAILED DESCRIPTION

As mentioned above, some printing devices may be configured to operate with a plurality of concatenated automatic print media feeder devices. In such systems, a piece or sheet of a print medium may require a significant amount of travel time to be transported from a tray in one of the concatenated feeder devices to where it is received by the printing device. Additionally, when the tray from which the print medium is requested is changed, the travel time and path may also change.

Unfortunately, in some systems this may cause print media to be unnecessarily delayed, or worse, arrive at the printing device in an unintended order. It may, therefore, be desirable to provide a system in which a printing device may receive requested printed media from a plurality of concatenated media feeder devices with minimal delay and in the intended order.

The present specification discloses systems and methods of printing in which a plurality of concatenated media feeder devices provide a media transport path to a printing device. Each of the feeder devices may be configured to feed a sheet or piece of a print medium to a neighboring device downstream in the media transport path only after receiving a logical token from the neighboring downstream device that corresponds to that sheet or piece of print media.

As used in the present specification and in the appended claims, the term "logical token" refers to a predetermined sequence of digital bits transmitted from a first electronic device to a second electronic device indicating that the second electronic device has permission to feed a piece of a print medium corresponding to a specific page in a print queue to the first electronic device.

As used in the present specification and in the appended claims, the term "upstream" refers generally to a direction along a media feed path that is away from a printing device, and the term "downstream" refers generally to a direction along the media feed path that is toward the printing device.

In the following description, for purposes of explanation, numerous specific details are set forth in order to provide a thorough understanding of the present systems and methods. It will be apparent, however, to one skilled in the art that the present systems and methods may be practiced without these specific details. Reference in the specification to "an embodiment," "an example" or similar language means that a particular feature, structure, or characteristic described in connection with the embodiment or example is included in at least that one embodiment, but not necessarily in other embodiments. The various instances of the phrase "in one embodiment" or similar phrases in various places in the specification are not necessarily all referring to the same embodiment.

The principles disclosed herein will now be discussed with respect to illustrative systems and methods of transporting print media.

Illustrative Systems

Figure 1:
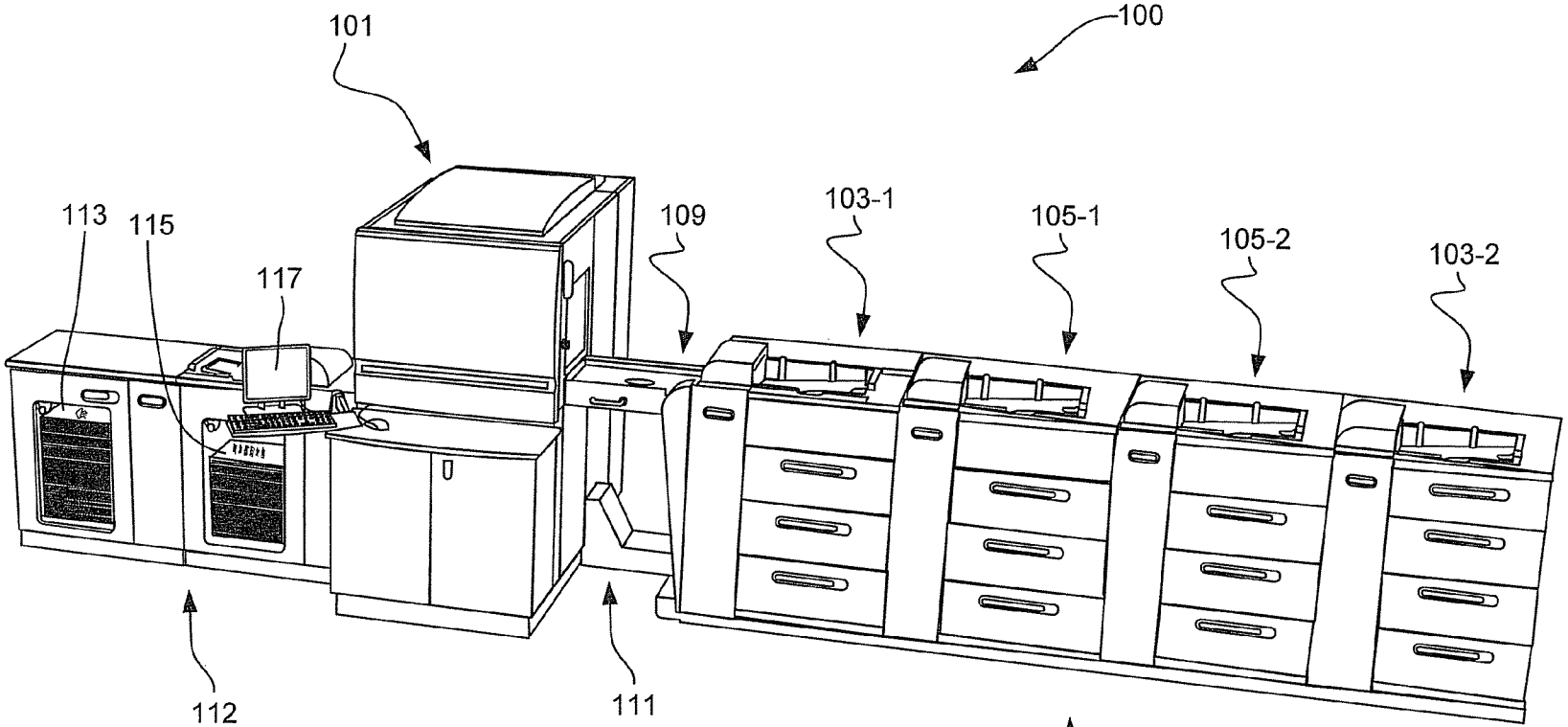
FIG. 1 is a perspective diagram of an illustrative pipeline of concatenated media feeder devices coupled to an illustrative printing device according to one exemplary embodiment of the principles described herein.

Referring now to FIG. 1, an illustrative printing system (100) is shown. The illustrative system (100) may include a printing device (101) coupled to a pipeline (102) of concatenated media feeder devices (103-1, 103-2, 105-1, 105-2).

It will be understood that the printing device (101) may include any suitable print engines in any suitable configuration as may fit a particular application of the principles described herein. For example, the printing device (101) may include, but is not limited to, at least one or more of: digital press printing components, offset printing components, laser printing components, inkjet printing components, movable type printing components, and the like.

Each of the media feeder devices (103-1, 103-2, 105-1, 105-2) may include a plurality of trays configured to store print media. It will be understood that the print media stored by the media feeder devices (103-1, 103-2, 105-1, 105-2) and used by the printing device (101) may include any suitable substrate or other material in any suitable configuration, as may fit a particular application of the principles described herein. For example, the print media may include, but are not limited to, at least one or more materials such as: common paper, cardstock, coated paper, film, cloth, plastic, metal, wood and the like.

The illustrated pipeline (102) may include first and second end feeder devices (103-1, 103-2, respectively) and first and second intermediate feeders (105-1, 105-2, respectively) that are disposed between the end feeder devices (103-1, 103-2). However, it will be appreciated by those skilled in the art that the pipeline (102) may include any number or configuration of feeder devices.

Each of the media feeder devices (103-1, 103-2, 105-1, 105-2) in the pipeline (102) may be configured to couple to a maximum of two neighboring devices to which it may be coupled: i.e., an "upstream" neighboring device—a neighboring device that is further away from the printing device (101) in the pipeline—and a "downstream" neighboring device—a neighboring device that is closer to the printing device (101).

In the present example, each of the feeder devices (103-1, 103-2, 105-1, 105-2) has a downstream neighboring device. For the first end feeder device (103-1), the downstream neighboring device is the printing device (101). For the first and second intermediate feeder devices (105-1, 105-2), the downstream neighboring devices are the first end feeder device (103-1) and the first intermediate feeder device (105-1), respectively. For the second end feeder device (103-2), the downstream neighboring device is the second intermediate feeder device (105-2).

Similarly, each of the first end feeder device (103-1), the first intermediate feeder device (105-1), and the second intermediate feeder device (105-2) of the present example has an upstream neighboring device. For the first end feeder device (103-1), the upstream neighboring device is the first intermediate feeder device (105-1). For the first intermediate feeder device (105-1), the upstream neighboring device is the second intermediate feeder device (105-2). For the second intermediate feeder device (105-2), the upstream neighboring device may be the second end feeder device (103-2). Only the second end feeder device (103-2) may be without an upstream neighboring feeder device in the pipeline (102) of the present example.

Each of the feeder devices (103-1, 103-2, 105-1, 105-2) may be configured to selectively feed print media to its respective downstream neighbor. Additionally, each of the feeder devices (103-1, 105-2, 105-1) having an upstream neighboring device may be configured to selectively receive print media from its respective upstream neighboring device.

In this configuration, the pipeline (102) may form a continuous feed path in that a piece of a print medium media may be transported from any of the feeder devices (103-1, 103-2, 105-1, 105-2) to the printing device (101). The first end feeder device (103-1) may be configured to transport all media to the printing device (101) using one or more input trays (109, 111).

To control media traffic along a continuous feed path, each of the feeder devices (103-1, 103-2, 105-1, 105-2) may be configured to feed a piece of a print medium to its respective neighboring downstream device only after having received a logical token corresponding to that particular piece of print media. Likewise, each of the printing device (101), the first end feeder device (103-1), and the intermediate feeder devices (105-1, 105-2) may be configured to issue logical tokens to their respective upstream neighboring devices corresponding to pieces of print media that must be received from the upstream neighboring devices in order to be fed to the printing device (101).

Print media that have passed through the printing device (101) may be transported from the printing device (101) to an output stacker (112) that may store one or more stacks (113, 115) of the printed media for retrieval by a user. The output stacker (112) may collate, sort, staple and perform other such functions on the stacks of printed media as directed by a user.

The system (100) may also include a workstation (117) configured to provide a human interface to the printing device (101). In certain embodiments, the workstation (117) may be configured to allow a human user to interact with the printing device in ways that include, but are not limited to, monitoring the status of the printing device (101) or the feeder devices (103-1, 103-2, 105-1, 105-2), diagnosing feed jams or other media feed anomalies, determining when a supply of a resource (i.e. ink, toner, print media, etc.) needs to be replenished, monitor the print job being performed by the printing device (101), and/or alter the print job being performed by the printing device (101).

Figure 2:
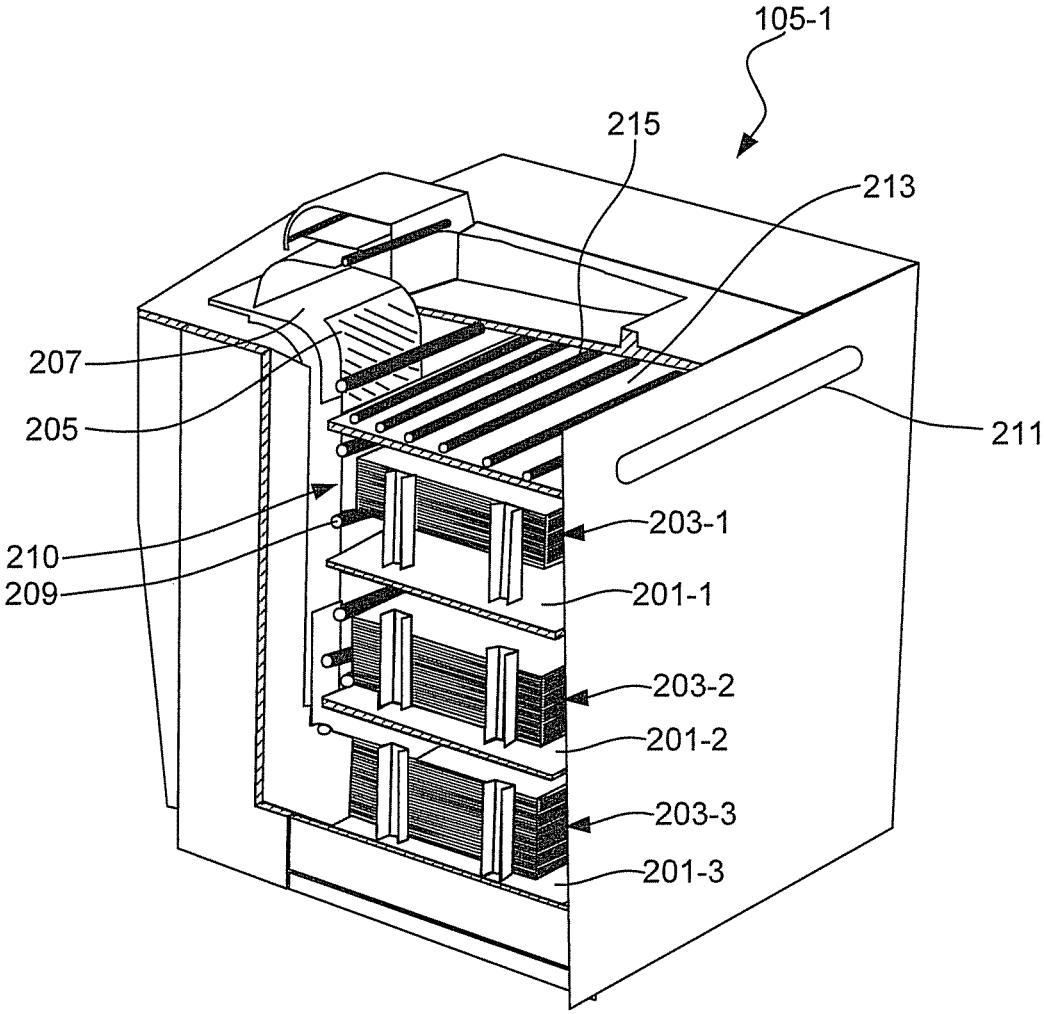
FIG. 2 is a perspective diagram of an illustrative print media feeder device according to one exemplary embodiment of the principles described herein.

Referring now to FIG. 2, a cutaway view is shown of an illustrative print media feeder device (105-1) in the pipeline (102, FIG. 1). The media feeder device (105-1) may include a plurality of trays (201-1 to 201-3) configured to house corresponding stores (203-1 to 203-3) of print media. In certain embodiments, a piece of a print medium (205) may be selectively retrieved from the stores (203-1 to 203-3) and transported through the feeder device (105-1) to an output port (207) using rollers (209) in a vertical conveyor apparatus (210). The vertical conveyor apparatus (210) may be configured to transport print media from within the internal trays (201-1 to 201-3) of the feeder device (105-1) to the output port (207). From the output port (207), the piece of print media (205) may be received by a downstream neighboring device in the pipeline (102, FIG. 1) and eventually be transferred into the printing device (101, FIG. 1).

The media feeder device (105-1) may also include an input port (211) through which print media may be received from an upstream neighboring device in the pipeline (102, FIG. 1). When a piece of a print medium is received through the input port (211), it may be received by a horizontal conveyor apparatus (213) in the media feeder device (105-1). The horizontal conveyor apparatus (213) may be configured to selectively transport pieces of print media received through the input port (211) of the feeder device (105-1) to the output port (207) of the feeder device (105-1).

In the present example, the first and horizontal conveyor apparatus (210, 213) includes a plurality of rollers (209, 215) configured to transport pieces of print media to the output port (207) of the feeder device (105-1). In other examples, however, the conveyor apparatus (210, 213) may include any combination of rollers, belts, vacuum devices, or other media transport devices, according to specific applications of the principles described herein.

In certain embodiments, a piece of a print medium may be received at the input port (211) of the feeder device (105-1) before a neighboring downstream device is prepared to receive the piece of print media. In such cases, the feeder device (105-1) may be configured to temporarily store the received piece of print media in the horizontal conveyor apparatus (213) of the media feeder device (105-1). The received piece of print media may then remain in the horizontal conveyor apparatus (213) until the neighboring downstream device is prepared to receive that piece of print media.

In some examples, the horizontal conveyor apparatus (213) may be capable of storing only a finite number (e.g. one) of received print media from the upstream neighboring device at a time. For this reason, the media feeder device (105-1) may be configured to refuse to permit the upstream neighboring device from feeding an additional piece of print media to the input port (211) of the feeder device (105-1) while the horizontal conveyor is apparatus (213) is occupied. This may be accomplished by the feeder device (105-1) delaying the issue of a logical token to the upstream neighboring device, where the logical token is needed for the upstream neighboring device to have authorization to transfer the additional piece of print media to the feeder device (105-1).

Similarly, the feeder device (105-1) may be configured to delay the transportation of the piece of print media (205) to the downstream neighboring device through the output port (207) until the logical token is received from the downstream neighboring device that authorizes the feeder device (105-1) to do so.

Figure 3:
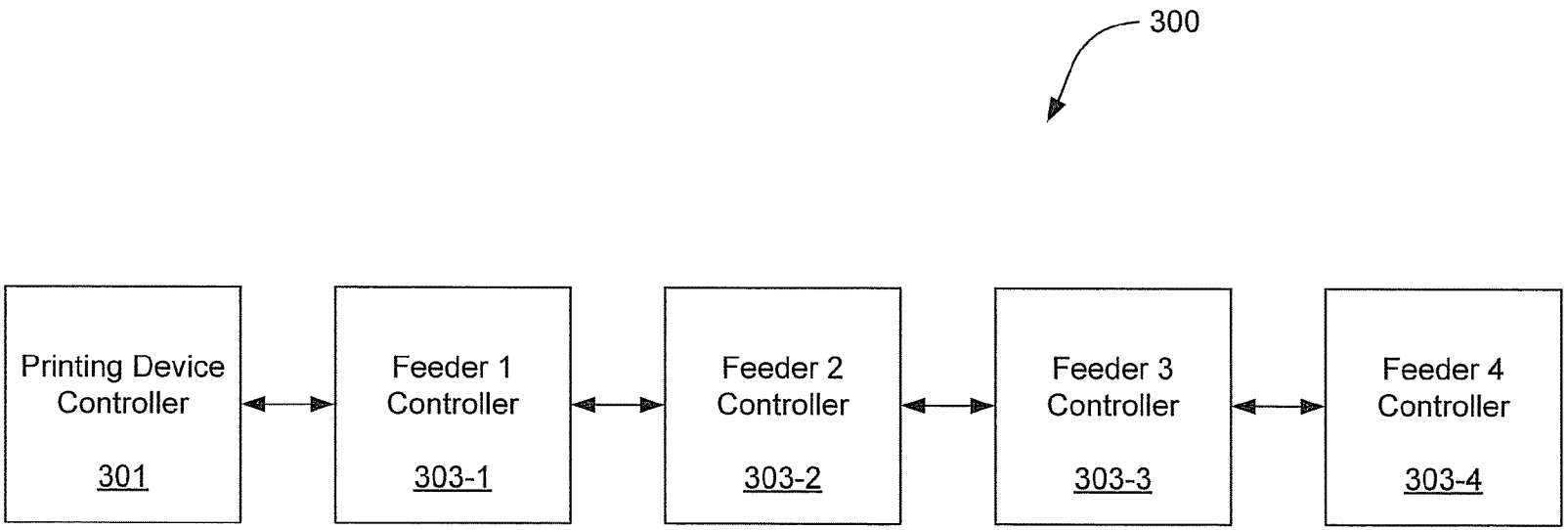
FIG. 3 is a block diagram of an illustrative communication configuration in a system having a pipeline of concatenated media feeder devices according to one exemplary embodiment of the principles described herein.

Referring now to FIG. 3, a block diagram is shown of an illustrative communication configuration (300) in a printing system having a printing device (101, FIG. 1) coupled to a pipeline of concatenated media feeder devices (103-1, 103-2, 105-1, 105-2, FIG. 1). In the configuration (300), a printing device controller (301) is communicatively coupled to a pipeline of concatenated feeder device controllers (303-1 to 303-4) corresponding to individual media feeder devices (103-1, 103-2, 105-1, 105-2, FIG. 1).

Each of the controllers (301, 303-1 to 303-4) may include at least one processor coupled to at least one memory device. The at least one processor may be configured to execute digital instructions stored on the at least one memory device. In certain embodiments, the at least one processor and/or the at least one memory device may be implemented in one or more integrated circuits.

In other embodiments, one or more of the controllers (301, 303-1 to 303-4) may be implemented as a software module that is executed by a computing device. In some such embodiments, a plurality of the feeder controllers (303-1 to 303-4) may be implemented by a common computing device that is configured to control the operations of the corresponding feeder devices.

Each of the plurality of feeder device controllers (303-1 to 303-4) may be communicatively coupled to a downstream neighboring device and an upstream neighboring device, where applicable. For a first of the feeder controllers (303-1), the downstream neighboring device is the printing device controller (301). In certain alternative embodiments, each of the feeder device controllers (303-1 to 303-4) may function as a type of store-and-forward node, where each feeder controller (303-1 to 303-4) is only able to communicate directly with its respective upstream and downstream neighboring devices.

Each of the controllers (301, 303-1 to 303-4) may communicate with neighboring controllers using any available coupling as may fit a particular application. For example, the controllers (301, 303-1 to 303-4) may communicate using physical cables, optical transmitters and receivers, wireless transmitters and receivers, and the like.

Any suitable communication protocol as may fit a particular application may be used to govern communications between the controllers (301, 303-1 to 303-4). Examples of suitable protocols that may be used in accordance with these principles include, but are not limited to, CAN bus, RS-232, RS-485, USB, and/or custom protocols specific to particular applications.

Using the present illustrative communication configuration (300), each of the feeder device controllers (303-1 to 303-4) may be configured to receive logical tokens from its respective downstream neighboring device. Likewise, the feeder device controllers (303-1 to 303-3) having upstream neighboring devices may be configured to provide logical tokens to their respective upstream neighboring devices. The logical tokens may include a recognized sequence of digital bits that permits a receiving feeder device controller (303-1 to 303-4) to transfer a specified piece of print media to its downstream neighboring device.

As mentioned above, each of the feeder controllers (303-1 to 303-4) may be configured to transfer a piece of a print medium to its downstream neighboring device only after receiving a logical token from the neighboring downstream device corresponding to that particular piece of media.

As all print media received by the printing device (101, FIG. 1) in the present examples may be received from the first end feeder device (103-1), the printing device controller (301) may be configured to issue tokens to the first feeder device controller (303-1) for each piece of print media to be used for printing pages in a printing queue. These tokens may be issued by the printing device controller (301) to the first feeder controller (303-1) in an order in which the pieces of print media are to be served up and printed (i.e. according to the order dictated by the print queue).

The print queue may be made available to each of the feeder device controllers (303-1 to 303-4) in order to allow additional tokens to be issued among the feeder device controllers (303-1 to 303-4) in anticipation of pieces of media that should be transported to the first feeder device, corresponding to the controller (303-1), according to the order in which media are required by the printing device (101, FIG. 1) and the location of the media to be printed.

Each of the feeder device controllers (303-1 to 303-4) may operate according to a standardized set of rules to allow requested pieces of media to be fed to the printing device (101, FIG. 1) in an orderly and efficient manner. In certain embodiments, these rules may include the following:

a. A feeder device controller (303-1 to 303-4) receiving a logical token corresponding to a particular piece of media in the printing queue will check the properties of the next piece of media in the printing queue. If this next piece of media is stored in a feeder device that is upstream from the present feeder device, the present feeder device controller (303-1 to 303-4) will issue a logical token to its upstream neighboring feeder device controller (303-1 to 303-4) corresponding to the next piece of media after a delay. The delay may be calculated by subtracting an estimated travel time of the piece of media from the time between the reception of the logical token corresponding to the present piece of media and the reception of a following logical token.

b. When a logical token corresponding to a particular piece of media in the printing queue is received by a feeder device controller (303-1 to 303-4) that does not house that particular piece of media, the feeder device controller (303-1 to 303-4) will verify that a logical token was already issued, or is pending issue, to the upstream feeder device controller that houses the piece of media. If a logical token corresponding to the piece of media has not been issued to the upstream feeder device controller that houses the piece of media, the present feeder device controller (303-1 to 303-4) will issue a logical token corresponding to the piece of media immediately to its upstream neighboring device.

To better illustrate the above constraints, Illustrative methods of issuing logical tokens in a pipeline of concatenated feeder devices (103-1, 103-2, 105-1, 105-2, FIG. 1) to control the transportation of media to a printing device will now be discussed in more detail.

Illustrative Methods

Figure 4:
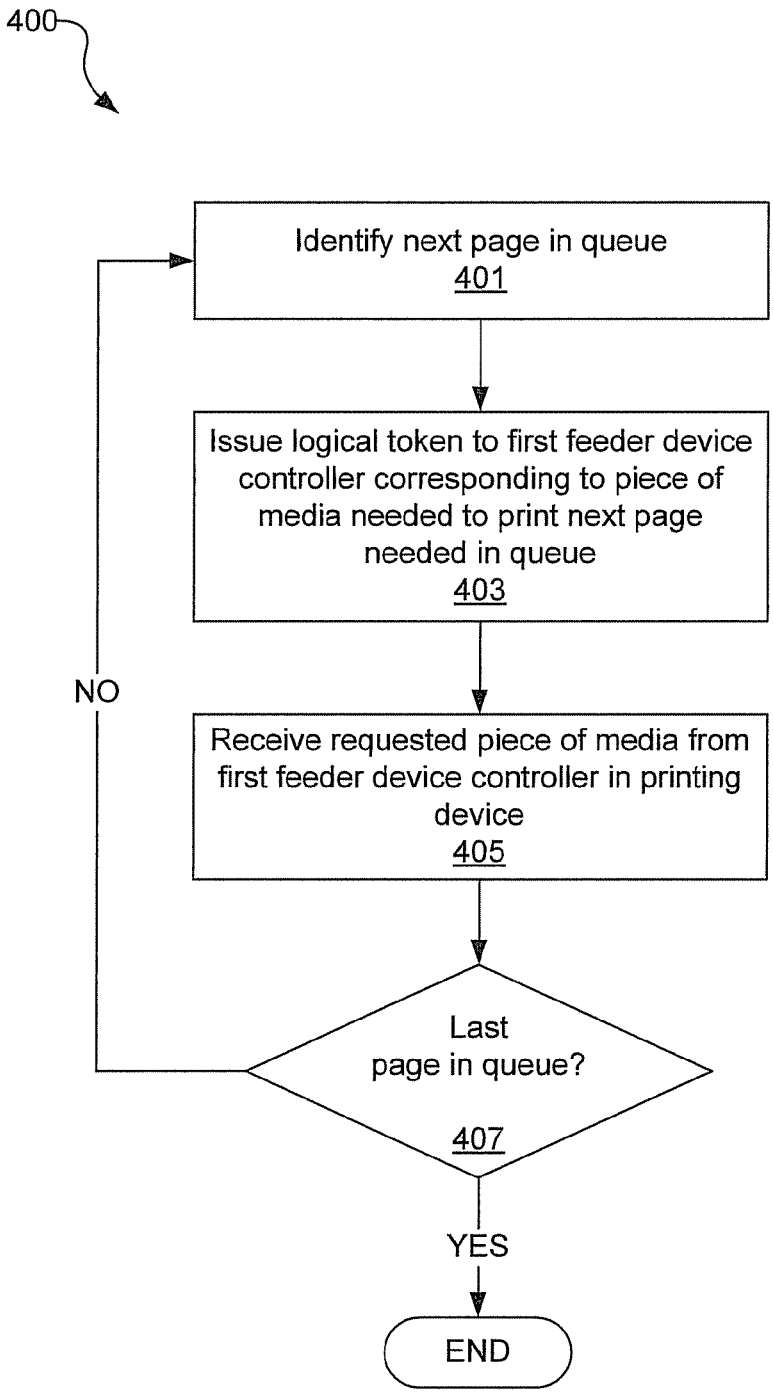
FIG. 4 is a block diagram of an illustrative method of logical token generation in a printing device controller according to one exemplary embodiment of the principles described herein.

Referring now to FIG. 4, an illustrative method (400) of managing the issue of logical tokens from a printing device controller will now be discussed. The printing device controller may first identify (step 401) a next page to be printed from a printing queue. The queue may include digital data stored in memory accessible to the printing device controller.

The printing device controller may then issue (step 403) a logical token to a first feeder device controller corresponding to a piece of media needed for the printing device to print the next page in the printing queue. After the printing device has received (step 405) the requested piece of media from the first feeder device, if the requested piece of media corresponds to the last page in the printing queue (step 407), the process is completed. Otherwise, the process is repeated.

This process illustrated in FIG. 4 focuses on the interaction between the printing device controller and the first feeder device controller. If the first feeder device does not contain the print medium requested, the desired print medium will be retrieved from a subsequent feeder device. This portion of the process will be explained with reference to FIG. 5.

Figure 5:
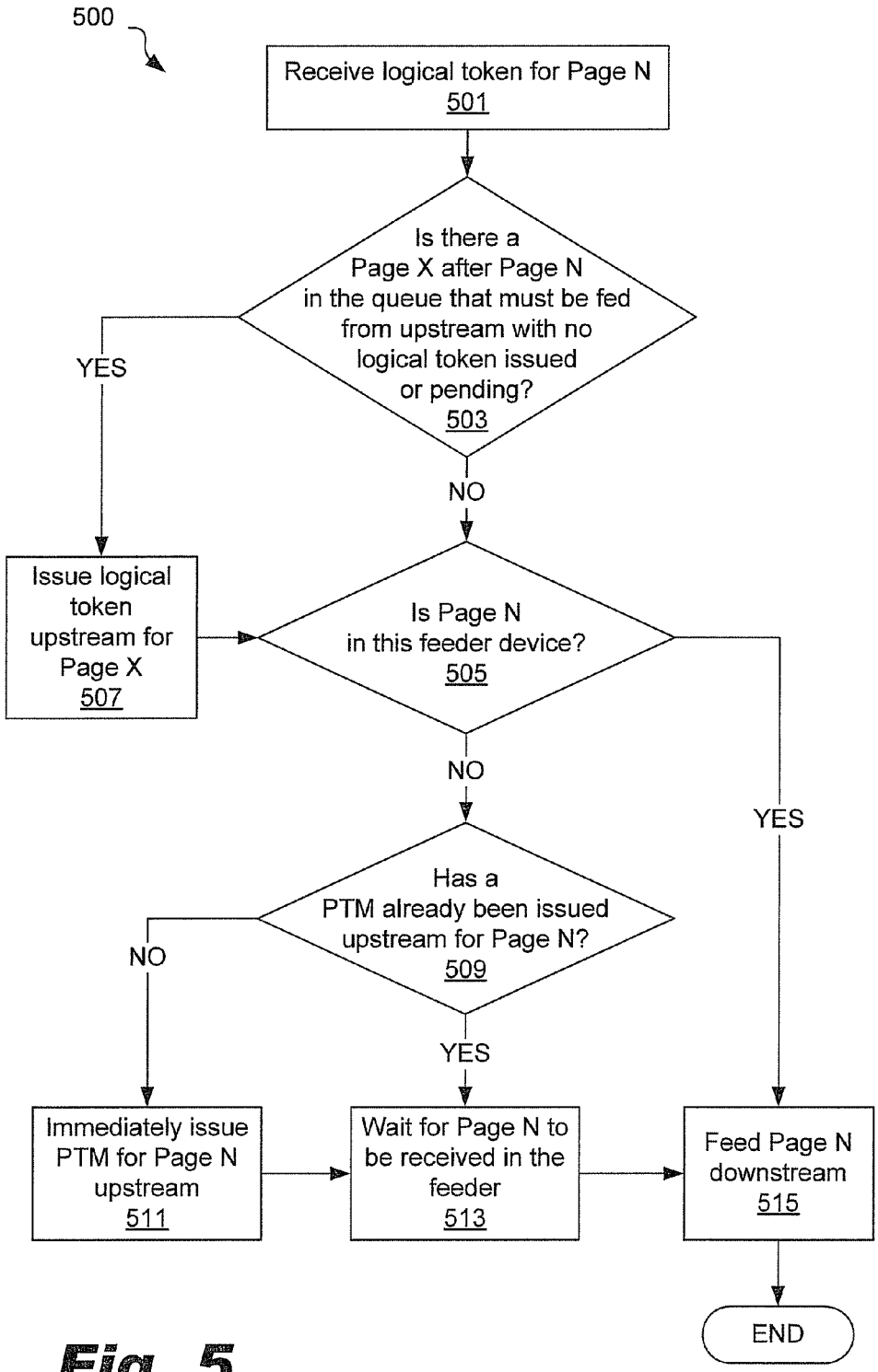
FIG. 5 is a block diagram of an illustrative method of logical token generation in a media feeder device controller according to one exemplary embodiment of the principles described herein.

Referring now to FIG. 5, an illustrative method (500) of managing the issue of logical tokens in a feeder device controller will now be discussed. When a logical token is received (step 501) in the feeder device controller that corresponds to a page (Page N) in a printing queue for a printing device, the feeder device controller may determine (step 503) if another page (Page X) exists in the queue that is to be printed after Page N, that must be fed from an upstream device, and for which no logical token has been issued upstream. In certain embodiments, the printing queue may be transmitted to each of the feeder device controllers from a printing device controller by propagating the printing queue data down the pipeline of feeder device controllers. In other embodiments, the feeder device controllers may be directly connected to a separate device that provides access to the printing queue.

In any event, if such a page (Page X) is found in the printing queue, the feeder device controller may issue (step 507) a logical token to its upstream neighboring feeder device controller. In some embodiments, this may occur after a calculated delay, as explained above.

Regardless of the existence of Page X, it may then be determined (step 505) if the page (Page N) for which the logical token was received (step 501) is stored in the present feeder device. If so, the page (Page N) may then be fed (step 515) to the downstream neighboring device of the present feeder device.

If the page (Page N) is not stored in the present feeder device, the feeder device controller may then determine (step 509) whether a logical token has already been issued upstream for the page (Page N). In the event that is determined (step 509) that a logical token has not already been issued upstream for the page (Page N), the present feeder device controller may immediately issue (step 511) a logical token to its neighboring upstream device that corresponds to the page (Page N). The feeder device controller may then wait (step 513) for the page (Page N) to be received in the feeder device from its neighboring upstream device. If it is determined that a logical token has already been issued upstream for the page (Page N), the present feed device controller may simply wait (step 513) for the page (Page N) to be received from its neighboring upstream device.

Once the page (Page N) has been received from the upstream neighboring device into the feeder device, the feeder device controller may cause the feeder device to feed (step 515) the page (Page N) to its neighboring downstream device.

Example

Figure 6A:
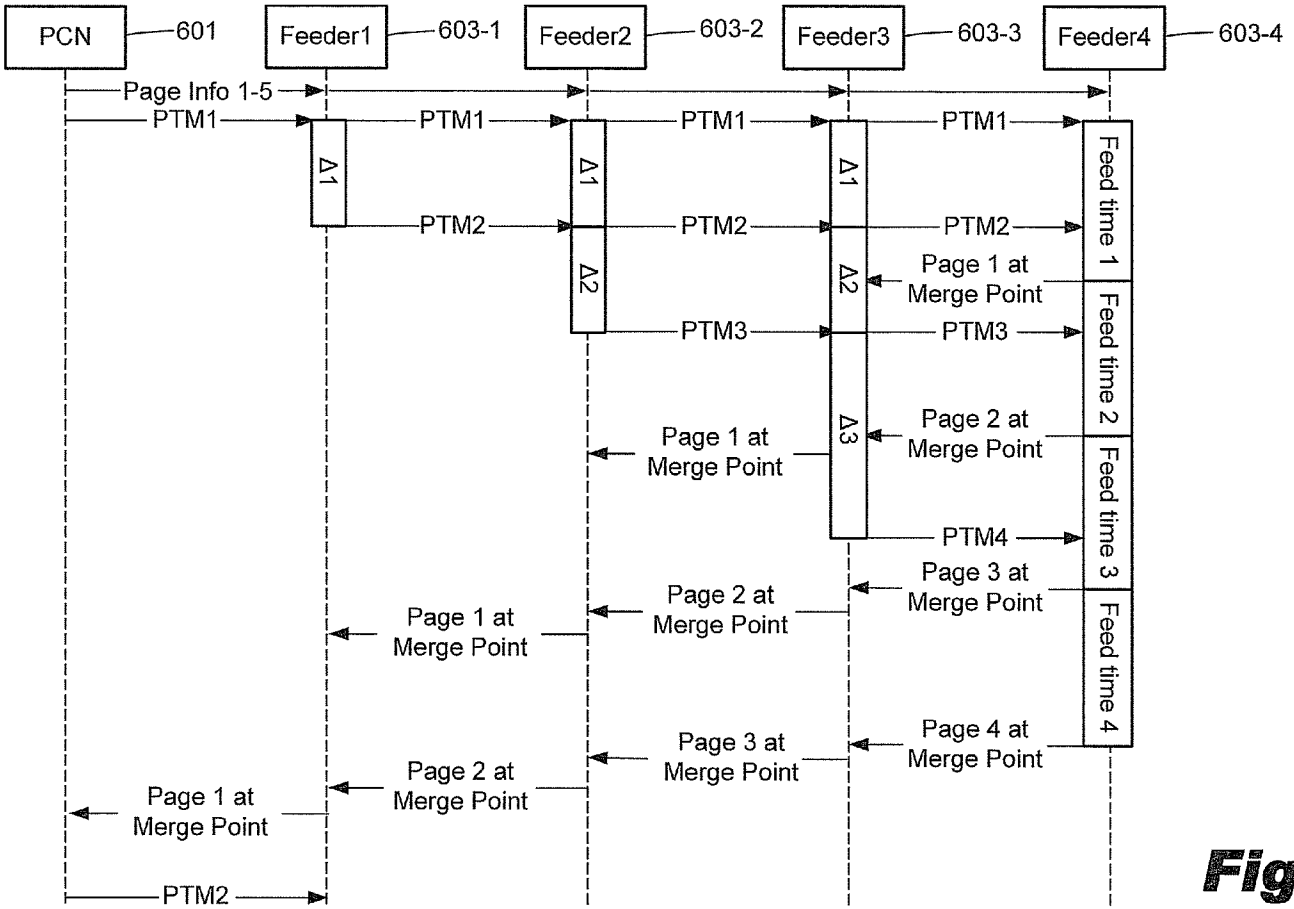
FIGS. 6A-6B are a diagram of illustrative operations in a printing device and coupled pipeline of concatenated media feeder devices according to one exemplary embodiment of the principles described herein.
Figure 6B:
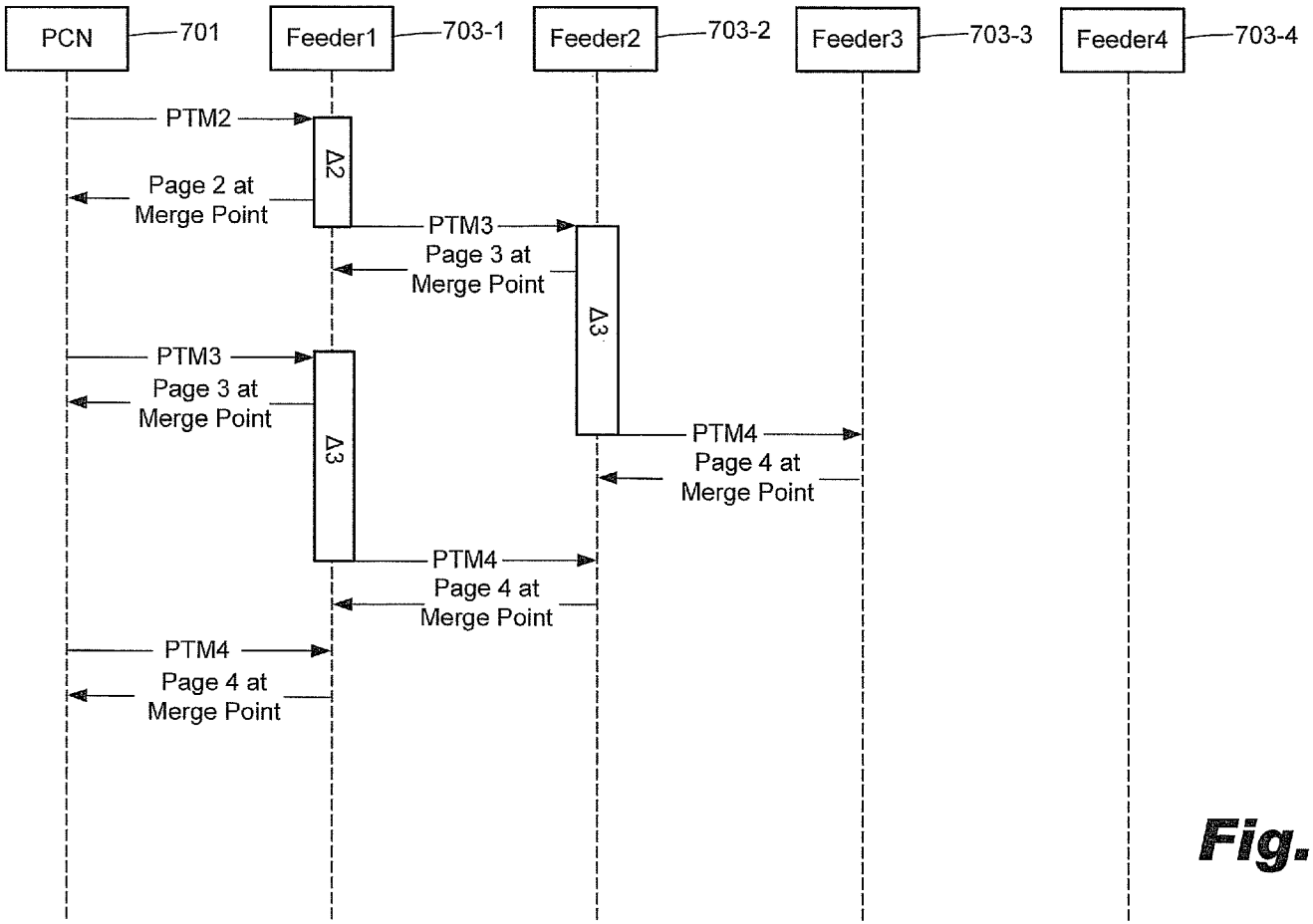

Referring now to FIGS. 6A-6B, an example of token passage and feed operations between a printing press device controller (601) and a plurality of concatenated feeder device controllers (603-1 to 603-4) is described in accordance with the principles described herein.

In the present example, the printing press device controller (601) operates according to the method described in FIG. 4 and the feeder device controllers are configured to operate according to the method described in FIG. 5. Upon commencement of the printing job, the printing press device controller (601) may provide printing queue data (Page Info 1-5) to each of the feeder device controllers (603-1 to 603-4). This queue data may be used by the feeder device controllers (603-1 to 603-4) to determine when to issue logical tokens to upstream neighboring devices and in the calculation of delays.

Logical tokens in the present example are implemented as PTM signals between devices, which is an abbreviation for "Permission to Merge." The progression of time in the present figure is illustrated by vertical movement along the chart. Thus, events that appear relatively aligned horizontally in the chart occur relatively simultaneously in the present example. FIG. 6B is a vertical extension of FIG. 6A.

As mentioned above, feeder device controllers (603-1 to 603-4) may issue logical tokens to upstream neighboring devices for subsequent pages after calculated delays ($\Delta 1$, $\Delta 2$, $\Delta 3$). These delays are represented in the present figure as vertical blocks representing the passage of time.

In the present example, when a page is in a position where it may be received by a neighboring downstream device, it is illustrated as at a "merge point." A page at a merge point may only be received by the neighboring downstream device after a logical token for that page has been issued by the neighboring downstream device.

Due to the potential complexity of the operations and communications among the printing press device controller (601) and the feeder device controllers (603-1 to 603-4), for illustrative purposes all five exemplary pages require print media stored in the last feeder device (603-4).

As shown in FIGS. 6A-6B, each of the desired pieces of print media is provided to the printing press device in the correct chronological order and with minimal delay. The principles described herein may enable much more complex print jobs to achieve similar results.

The preceding description has been presented only to illustrate and describe embodiments and examples of the principles described. This description is not intended to be exhaustive or to limit these principles to any precise form disclosed. Many modifications and variations are possible in light of the above teaching.

What is claimed is:

1. A system, comprising:

a first end feeder device; and a second end feeder device upstream in a media transport path from said first end feeder device;

wherein each of said feeder devices is configured to feed one or more pieces of print media to a neighboring device downstream in said media transport path only after receiving, for each piece of print media, a logical token from said neighboring downstream device, wherein each logical token uniquely corresponds to said each piece of print media.

2. The system of claim 1, wherein said media transport path comprises at least one intermediate feeder device disposed between said first and second end feeder devices.

3. The system of claim 1, wherein at least said first end feeder device comprises a conveyor apparatus configured to receive print media from one or more neighboring upstream devices.

4. The system of claim 1, wherein said first end feeder device is further configured to:

receive a first logical token from said neighboring downstream device corresponding to a first piece of a print medium located in a neighboring device upstream from said first end feeder device; and issue a second logical token corresponding to said first piece to said neighboring upstream device upon determining that no logical token corresponding to said first piece of print media has already been issued or is pending issue to said neighboring upstream device.

5. The system of claim 1, wherein said first end feeder device is further configured to:

receive a first logical token from said neighboring downstream device corresponding to a first piece of a print medium for a specific page in a print queue;

search said print queue for a subsequent page which it is anticipated that said first end feeder device will receive from a neighboring upstream device, and for which no corresponding logical token has been issued to said neighboring upstream device; and issue a second logical token corresponding to said subsequent page to said neighboring upstream device.

6. The system of claim 1, wherein said neighboring downstream device of said first end feeder device comprises a printing device.

7. The system of claim 6, wherein each of said feeder devices further comprises a controller configured to receive said logical token and selectively control transportation of said print media within said feeder device.

8. A system, comprising:

a printing device; and a plurality of concatenated feeder devices comprising a continuous media feed path coupled to said printing device, wherein each of said plurality of concatenated feeder devices is configured to feed one or more pieces of print media to a neighboring device downstream in said continuous media feed path only after receiving, for each piece of print media, a logical token from said neighboring downstream device, wherein each logical token uniquely corresponds to said each piece of print media.

9. The system of claim 8, wherein each of said plurality of concatenated feeder devices is communicatively coupled to said neighboring downstream device.

10. The system of claim 8, wherein said plurality of concatenated feeder devices comprises a first end feeder device, a second end feeder device disposed upstream from said first end feeder device, and at least one intermediate feeder device disposed between said end feeder devices.

11. The system of claim 10, wherein said neighboring downstream device of said first end feeder device is said printing device.

12. The system of claim 11, wherein each of said first end feeder device and said at least one intermediate feeder device is further configured to:

receive a first logical token from said neighboring downstream device corresponding to a first piece of print media located upstream in another feeder device; and issue a second logical token corresponding to said first piece of print media to a neighboring upstream feeder device upon determining that no logical token corresponding to said first piece of print media has already been issued or is pending issue to said neighboring upstream device.

13. The system of claim 8, wherein each of said first end feeder device and said at least one intermediate feeder device is further configured to:

search a print queue of said printing device for a subsequent page which it is anticipated that said feeder device will receive from a neighboring upstream feeder device, and for which no corresponding logical token has been issued to said neighboring upstream device; and issue a logical token corresponding to said subsequent page to said neighboring upstream device after a calculated delay.

14. The system of claim 8, wherein each of said plurality of concatenated feeder devices comprises a plurality of rollers configured to transport said one or more pieces of print media from storage in said feeder device to said neighboring downstream device.

15. The system of claim 8, wherein each of said plurality of concatenated feeder devices comprises a controller configured to communicate with neighboring devices and selectively control transportation of said print media within said feeder device.

16. A method, comprising:

for each piece of a plurality of pieces of media:

receiving a logical token uniquely corresponding to the piece of media in a first feeder device of a plurality of concatenated feeder devices comprising a continuous media feed path; and in response to receiving the logical token, feeding the piece of media to a neighboring device downstream in said continuous media feed path.

17. The method of claim 16, further comprising determining if said piece of media is housed in said first feeder device.

18. The method of claim 16, further comprising:

searching a print queue for a subsequent page which it is anticipated that said first feeder device will receive from a neighboring feeder device upstream in said continuous media feed path, and for which no corresponding logical token has been issued to said neighboring upstream device; and issuing a second logical token corresponding to said subsequent page to said neighboring upstream device after a calculated delay.

19. The method of claim 16, further comprising:

determining that a first logical token corresponds to a first piece of media located upstream in said feed path, for which a logical token has not been issued to a neighboring upstream feeder device; and issuing a second logical token corresponding to said first piece of media to said neighboring upstream feeder device.

20. The method of claim 19, further comprising receiving said first piece of media from said neighboring upstream feeder device prior to feeding said first piece of media to said neighboring downstream device.

* * * * *